US005303521A

United States Patent [19]

Jansen

[11] Patent Number: 5,303,521

[45] Date of Patent: Apr. 19, 1994

[54] FASCIA PANEL

[75] Inventor: James M. Jansen, Gepps Cross, Australia

[73] Assignee: Stratco Metal Proprietary Limited, Gepps Cross, Australia

[21] Appl. No.: 867,815

[22] Filed: Apr. 13, 1992

[30] Foreign Application Priority Data

Apr. 12, 1991 [AU] Australia ..... PK5563

[51] Int. Cl.[5] ..... E04D 13/04

[52] U.S. Cl. ..... 52/94; 52/11; 52/95; 52/96

[58] Field of Search ..... 52/11, 94, 95, 96

[56] References Cited

U.S. PATENT DOCUMENTS

| | | | |
|---|---|---|---|
| 3,024,573 | 3/1962 | McKinley | 52/96 |
| 3,864,882 | 2/1975 | Lassock | 52/11 |
| 3,984,951 | 10/1976 | Hindman | 52/96 |
| 4,128,974 | 12/1978 | Taylor | 52/11 |
| 4,262,459 | 4/1981 | Hallman | 52/11 |

FOREIGN PATENT DOCUMENTS

| | | | |
|---|---|---|---|
| 2275608 | 1/1976 | France | 52/94 |

*Primary Examiner*—Carl D. Friedman

*Assistant Examiner*—Christopher T. Kent

*Attorney, Agent, or Firm*—Edward W. Callan

[57] ABSTRACT

This invention comprises an improved fascia panel and method of securing the fascia panel to a plurality of mounting brackets. The fascia panel 11 comprises a first portion 18 which is substantially vertical when the panel is secured to brackets and a second portion 19 which is below the first portion 18 where the second portion 19 is at an angle with respect to the first portion 18 such that the lower edge of the second portion 19 is rearward of the front face of the first portion 18.

A first attachment means 20 is formed along the upper edge of the first portion 18, and a second attachment means 24 along the lower edge of the second portion 19. A plurality of mounting brackets 12 are provided which can be secured to a structure, and are provided with means to engage both the first and second attachments means 20 and 24 so as to secure the fascia panel thereto.

The invention provides a means of quickly and easily securing a fascia panel to a structure, and the design of the fascia panel wherein the lower edge of the second portion 19 is rearward of the first portion 18 provides a greater degree of torsional rigidity and shear strength.

5 Claims, 2 Drawing Sheets

FASCIA PANEL

Figure 1:
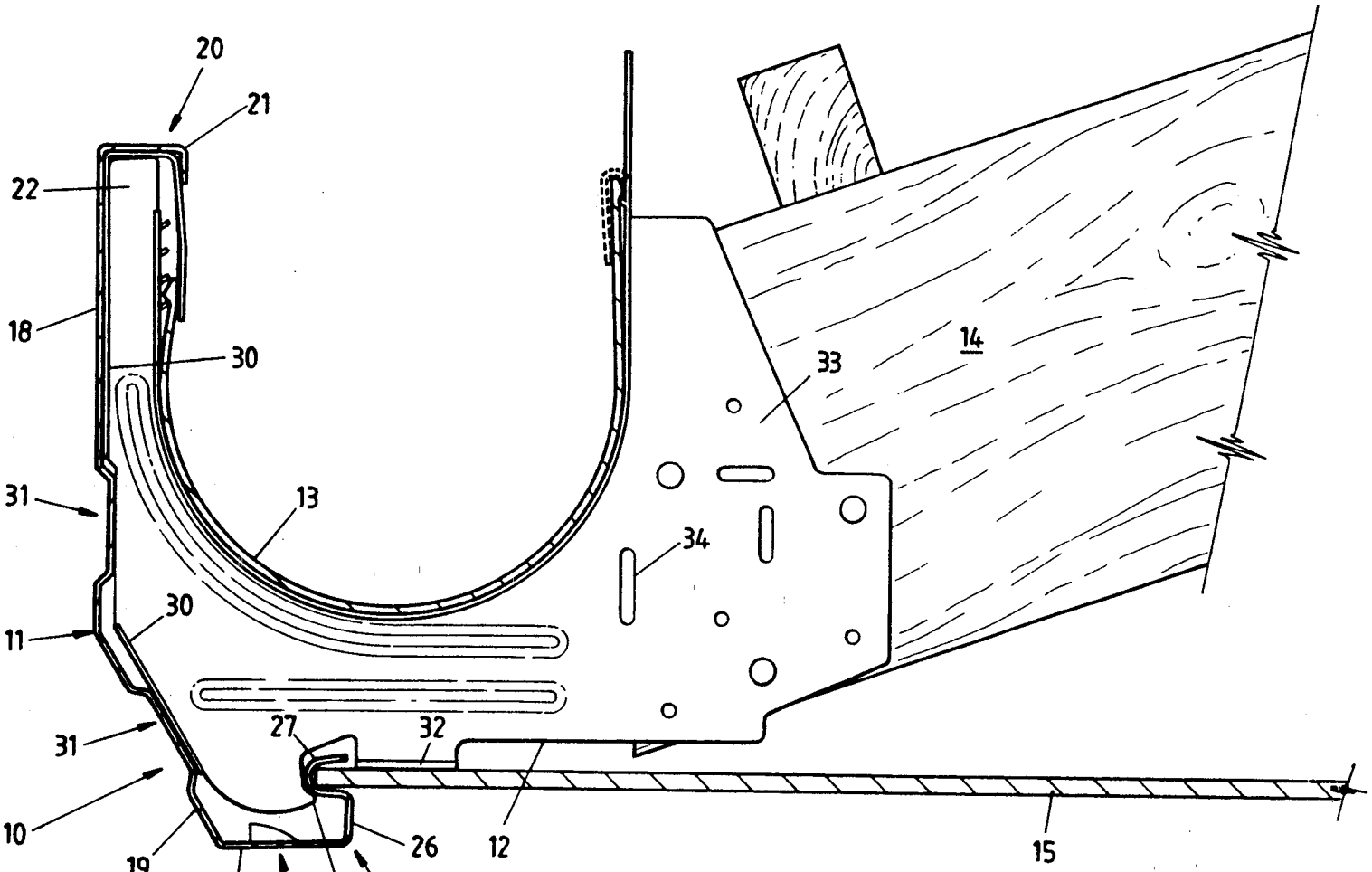

This invention relates to an improved fascia panel, and also relates to a means of fixing the fascia panel to a structure.

Although this invention will find many applications, its main application relates to the use of a fascia panel in relation to roofing structures. However, it should be realised that the scope of this invention is not limited solely to roofing structures.

Conventional roofing structures normally comprise rafters for supporting roof tiles or roof covers, a barge board positioned along the ends of the rafter beams, and a soffit panel that extends between the barge board and exterior wall. The gutter may then be attached to the exterior surface of the barge board such that rainwater flowing from the roof is directed into the gutter.

Construction of a roof and the eaves of a house using the above method is costly and time consuming. In addition, there is a great deal of care required in accurate fitting and positioning of the various components to produce a sound structure that has a neat appearance.

Therefore, it is an object of this invention to overcome the abovementioned difficulties and in addition it is an object of the invention to provide a fascia panel which replaces conventional barge boards, and in addition to provide means of fixing such a fascia panel in place.

One aspect, the invention comprises an improved fascia panel and mounting brackets for securing said fascia panel to the roof of a building, comprising an elongated fascia panel that, when secured to the roof of a building, comprises a first substantially vertical planar portion having a front face; a second substantially planar portion bent or formed away from the first portion at an oblique angle to the vertical, such that the lower edge of said second portion is rearward of the front face of said first portion; a first attachment means along the upper edge of said first portion comprising a channel formed by a horizontal upper edge and a vertical outer edge; and a second attachment means along the lower edge of said second portion comprising a substantially horizontal portion extending from the lower edge of said second portion, and an upstanding portion having an elongate projecting ridge formed therein that projects toward said second portion; and a plurality of mounting brackets, each securable to a building in a spaced manner around the roof of a building, having a projection over which said first attachment means locates, an angled edge against which said second planar portion abuts, and a recess within which said ridge locates, said recess being positioned such that said upstanding portion resiliently deforms to allow said ridge to locate in said recess, and once located, said upstanding portion remains resiliently deformed thereby positively holding said fascia panel to each said bracket.

Preferably, the fascia panel is formed either by roll-forming a strip, or forming the elongate strip by continuous extrusion. In order to improve the torsional rigidity of the fascia panel, as well as improving the visual appearance, both the first and second portions may have elongate ribbing or projections formed along the longitudinal access of the panel.

In forming the fascia panel, the second portion is bent or formed away from the plane of the first portion, such that the lower edge of the second portion is to the rear of the vertical portion. This return or recessed portion provides a greater degree of torsional rigidity and shear strength.

The attachment means along the upper edge of the first surface, and along the lower edge of the second surface may comprise a continuously formed channel, or channel portions at spaced intervals. The channel portions may be formed into either a hook for location over a corresponding projection, or may be formed into a ridge for location in a corresponding recess.

The fascia panel may be provided with apertures at spaced intervals for drainage purposes. Obviously, such an aperture would be located in the lower most portion of the fascia panel.

Preferably, the brackets are attached to a structure at spaced intervals, the intervals being sufficient to rigidly support the fascia panel. In the case of a roofing structure, the brackets may be secured to the rafters, such that the fascia panel replaces the barge board that might be normally attached to the rafters.

Preferably, the first portion of the bracket may have apertures for nailing or screwing the bracket to the rafters.

In addition, further apertures may be provided to produce a line of weakness between the first and second portions of the bracket to allow the first portion to be bent at an angle with respect to the second portion. This will allow correct orientation of the second portion when the bracket is attached to a surface or rafter that is at an angle to desired orientation of the bracket.

The means by which the second portion attaches to the fascia panel may comprise projections, recesses or any other suitable means that correspond to the attachment means used on the fascia panel. Preferably, the fascia panel is formed from resilient material and the attachment means on the fascia panel are arranged so that it can be snapped into place once the brackets are positioned on the structure.

In the case of roof installations, the bracket may be provided with a recess between the rafter and the fascia panel for the location therein of a gutter. Obviously, the recess is located directly under the edge of the roofing material such that water from the roof is directed into the gutter. Alternatively, the bracket may be designed such that the gutter is attached to the external surface of the fascia panel in the desired location.

In order to firmly locate fascia panel, the bracket may be provided with flanges that abut against the internal surface of the fascia panel.

In addition, the bracket and fascia panel may be provided with a means of facilitating soffit panel securement.

The lower edge of the second surface of the fascia panel may be provided with a channel within which the outer edge of the soffit panel may locate. In addition, the bracket may be provided with a flange that abuts against the inside surface of the soffit panel. The soffit panel may be secured to this flange by threaded fasteners or other fastening means.

In addition, the position of the flange for soffit securement may be adjustable so as to allow the flange to be positioned for attachment to a raked soffit.

In another aspect, the invention comprises an improved fascia panel and mounting brackets for securing said fascia panel to the roof of a building, comprising an elongated fascia panel that, when secured to the roof of a building, comprises a first substantially vertical planar portion having a front face; a second substantially planar portion bent or formed away from the first portion at an oblique angle to the vertical, such that the lower edge of said second portion is rearward of the front face of said first portion; a first attachment means along the upper edge of said first portion; and a second attachment means along the lower edge of said second portion comprising a substantially horizontal portion extending from the lower edge of said second portion; and a plurality of mounting brackets that engage with both said first and second attachment means to secure the fascia panel to said brackets, each bracket being securable to a building in a spaced manner around the roof of a building.

In still another aspect, the invention comprises an improved fascia panel and mounting brackets for securing said fascia panel to the roof of a building, comprising an elongated fascia panel that, when secured to the roof of a building, comprises a first approximately vertical portion having a front face; a second portion having a lower edge that is rearward of the front face of said first portion; a first attachment means along the upper edge of said first portion; and a second attachment means along the lower edge of said second portion comprising an approximately horizontal portion extending from the lower edge of said second portion, and an upstanding portion having an elongate projecting ridge formed therein that projects toward said second portion; and a plurality of mounting brackets that engage with both said first and second attachment means to secure the fascia panel to said brackets, each bracket being securably to a building in a spaced manner around the roof of a building and having an edge against which said second portion abuts and a recess within which said ridge locates, said recess being positioned such that said upstanding portion resiliently deforms to allow said ridge to locate in said recess, and once located, said upstanding portion remains resiliently deformed thereby positively holding said fascia panel to each said bracket.

In order that the invention may be readily understood, preferred embodiments will now be described, but it should be realised that the invention is not restricted to the combinations of the preferred embodiments described.

Figure 2:
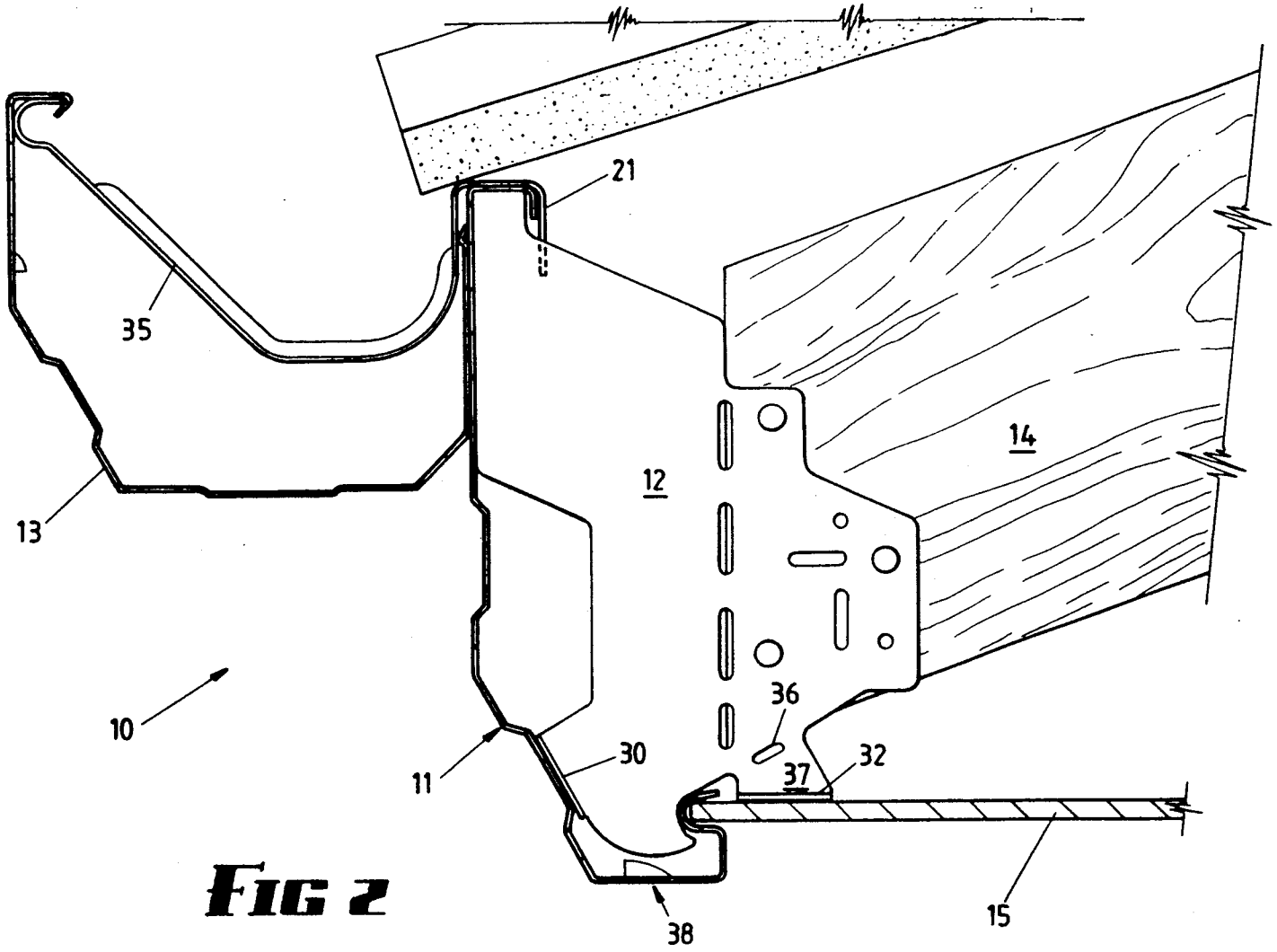

The embodiments are illustrated in the accompanying figures, in which:

FIG. 1 illustrates the first embodiment showing a bracket attached to a rafter and showing the fascia panel and gutter in cross-section and, FIG. 2 shows a second embodiment of the invention showing a bracket attached to a rafter, and having a fascia panel shown in section attached to the bracket with a gutter, again shown in section, attached to the external surface of the fascia panel.

In the first embodiment illustrated in FIG. 1, there is shown an assembly 10 comprising a fascia panel 11, a bracket 12 and a gutter 13. The bracket 12 is secured to a rafter 14 and a soffit panel 15.

In this embodiment, the fascia panel 11 comprises a first portion 18, and a second portion 19. As can be seen in FIG. 1 the first portion 18 of the fascia panel 11, when secured to the bracket 12, is substantially vertical, and the second portion 19 is formed at an angle to the first portion 18 such that the second portion 19 is to the rear of the front face of the first portion 18.

A first attachment means 20 comprises a channel 21 which locates over a projection 22 on the bracket 12. The channel 21 is formed continuously along the upper edge of the vertical portion 18, and hooks over the projection 22.

The second attachment means 24 comprises a horizontal web 25, a vertical web 26 and a ridge portion 27. The ridge portion 27 locates into a corresponding recess within the bracket, the recess being defined by a cutaway portion behind a point 28 on the bracket 12.

To fit the fascia panel 11 to the bracket 12, the hook portion 21 is located over the spigot 22 and the ridge portion 27 slides along the ramp surface 29 until it locates within the recess behind the point 28. The bracket 12 is dimensioned so that the fascia panel 11 is slightly sprung open so that the spring force tightly holds the fascia panel 11 to the bracket 12.

In order to securely locate the fascia panel 11 to the bracket 12, flanges 30, which are perpendicular to the plane of the bracket 12 abut against the inside surfaces of the fascia panel 11. In order to provide additional rigidity, the fascia panel 11 may have ribs 31 formed into the length of the fascia panel 11.

The bracket 12 and fascia panel 11 are provided with securement means for attaching the outer edge of the soffit panel 15 thereto. Firstly, the ridge portion 27 forms a channel into which the outer edge of the soffit panel 15 locates. Further, the bracket 12 is provided with a flange 32 that allows securement of the soffit panel to the bracket 12 by way of a threaded fastener. The flange 32 is sufficiently wide to allow the drilling of a hole therein, and a self-threading fastener can be used to secure the soffit panel 15 to the flange 32.

The bracket 12 has a first portion 33 which has a plurality of apertures which allow securement of the bracket 12 to the rafter 14. In addition there is provided a slot 34 which produces a line of weakness in this region so that the first portion 33 can be positioned at an angle in relation to the remainder of bracket 12 so that it can be fixed to rafters located in corners or other areas where the angle of the bracket 12 needs to be adjusted.

The assembly 10 shown in FIG. 2 is similar to the assembly 10 shown in FIG. 1 however, the gutter 13 is located externally with respect to the fascia panel 11, and therefore the bracket 12 is not provided with a recess in which to locate the gutter between the rafters 14 and the fascia panel 11. However, the essential features of the fascia panel 11 and the bracket 12 remain unchanged.

Other minor variations include the use of only one flange 30 on the bracket 12 and the location of a gutter strap 35 over the channel 21 of the fascia panel 11.

In addition, the flange 32 for soffit panel 15 connection may be bent along the line formed by the slot 36 so that the soffit panel 15 may be secured to surface 37. This allows the soffit panel 15 to be installed in a raked configuration.

In both embodiments, apertures 38 are provided for drainage of the lower portion of the fascia panel 11. A number of drainage apertures 38 are formed at spaced intervals along the length of the fascia panel, and the preferred spacing is approximately 100 mm between adjacent apertures 38.

It will be clear from review of the invention, that it provides both a novel fascia panel and a novel bracket to which the fascia panel can be secured. Although these embodiments have been described in relation to fascia panel installation to a roof, it is clear that the invention will find application in other areas where fascia panels are secured to structures.

We claim:

1. An improved fascia panel and mounting brackets for securing said fascia panel to the roof of a building, comprising an elongated fascia panel that, when secured to the roof of a building, comprises a first substantially vertical planar portion having a front face;

a second substantially planar portion bent or formed away from the first portion at an oblique angle to the vertical, such that the lower edge of said second portion is rearward of the front face of said first portion;

a first attachment means along the upper edge of said first portion comprising a channel formed by a horizontal upper edge and a vertical outer edge; and a second attachment means along the lower edge of said second portion comprising a substantially horizontal portion extending from the lower edge of said second portion, and an upstanding portion having an elongate projecting ridge formed therein that projects toward said second portion; and a plurality of mounting brackets, each securable to a building in a spaced manner around the roof of a building, having a projection over which said first attachment means locates, an angled edge against which said second planar portion abuts, and a recess within which said ridge locates, said recess being positioned such that said upstanding portion resiliently deforms to allow said ridge to locate in said recess, and once located, said upstanding portion remains resiliently deformed thereby positively holding said fascia panel to each said bracket.

2. An improved fascia panel according to claim 1 wherein a plurality of apertures are formed in the lowest region of the second portion so as to allow drainage of fluid therefrom.

3. An improved fascia panel according to claim 1 wherein said bracket is formed from sheet material, and has flanges formed in the same plane as said first and second portions of the fascia panel which abut against the inner surfaces of the fascia panel.

4. An improved fascia panel according to claim 1 wherein said lower edge of the second portion further comprises a continuous channel within which the outer edge of a soffit panel may locate.

5. An improved fascia panel according to claim 4 wherein the bracket further comprises a flange formed in the plane of said soffit panel for securement thereto.

* * * * *